US009622586B1

(12) United States Patent
Hummel et al.

(10) Patent No.: US 9,622,586 B1
(45) Date of Patent: Apr. 18, 2017

(54) WALL MOUNTABLE SEATING DEVICE

(71) Applicants: Rhonda Lynn Hummel, St. Joseph, MI (US); Rayetta Marie Nasseh, Bridgman, MI (US)

(72) Inventors: Rhonda Lynn Hummel, St. Joseph, MI (US); Rayetta Marie Nasseh, Bridgman, MI (US)

( * ) Notice: Subject to any disclaimer, the term of this patent is extended or adjusted under 35 U.S.C. 154(b) by 0 days.

(21) Appl. No.: 15/071,692

(22) Filed: Mar. 16, 2016

(51) Int. Cl.

| | |
|---|---|
| ***A47C 7/58*** | (2006.01) |
| ***A47C 7/40*** | (2006.01) |
| ***A47C 7/56*** | (2006.01) |
| ***A47C 7/54*** | (2006.01) |

(52) U.S. Cl.
CPC ..... *A47C 7/58* (2013.01); *A47C 7/40* (2013.01); *A47C 7/543* (2013.01); *A47C 7/566* (2013.01)

(58) Field of Classification Search
CPC .. A47C 1/126; A47C 7/56; A47C 7/30; A47C 7/58; A47C 7/40; A47C 7/543; A47C 7/566; A47C 7/70
USPC ..... 297/14, 468, 188.15, 188.17, 144, 145, 297/188.11, 332, 333, 485, DIG. 6, 334, 297/35, 41, 15, 16.1
See application file for complete search history.

(56) References Cited

U.S. PATENT DOCUMENTS 146,523 A * 1/1874 Formica et al. ..... A47C 4/24 297/35
1,104,615 A * 7/1914 Braden ..... A47C 7/56 297/332
1,289,897 A * 12/1918 Phillips ..... A47C 17/86 312/246
1,692,930 A * 11/1928 Cummings ..... A47B 5/04 108/38
1,712,704 A 5/1929 Kiser
2,559,548 A 7/1951 Seigneur
3,093,414 A * 6/1963 Eames ..... A47C 1/126 297/14
3,343,871 A 9/1967 Yates
4,205,670 A * 6/1980 Owens ..... B60R 22/105 128/875
5,215,354 A * 6/1993 Grene ..... B60N 2/24 297/466
5,586,806 A * 12/1996 Hergott ..... A47C 7/70 297/188.11
5,725,275 A * 3/1998 Wigfall ..... A61G 5/1002 297/183.1
5,791,729 A * 8/1998 McCormick ..... A47C 9/06 297/14
6,807,690 B1 * 10/2004 Satterfield ..... A47K 3/282 297/14
6,896,322 B1 * 5/2005 Foy ..... A47C 1/126 297/129

(Continued)

FOREIGN PATENT DOCUMENTS

JP 06122339 A * 5/1994

*Primary Examiner* — Milton Nelson, Jr.
(74) *Attorney, Agent, or Firm* — Brooklyn Law IP Clinic; Serge Krimnus; Judy Kim

(57) ABSTRACT

A seating apparatus with one or more support members including one or more attachment points. The attachment points allow for attachment to a seating member for attachment to an attachment location of the one or more support members. The attachment points also allow for attachment to a one or more armrest member for attachment to an attachment location of the one or more support members.

20 Claims, 7 Drawing Sheets

(56) References Cited

U.S. PATENT DOCUMENTS 7,073,852 B1 * 7/2006 Zheng ..... A47C 4/286
297/16.2

* cited by examiner

WALL MOUNTABLE SEATING DEVICE

BACKGROUND OF THE INVENTION

The present invention is in the technical field of folding seating devices. More particularly, the present invention is in the technical field of wall mounted folding seating devices. More particularly, the present invention is in the technical field of emergency and safety devices.

SUMMARY OF THE INVENTION

An embodiment provides a seating apparatus that is attached to a wall. This seating apparatus may be used in an elevator during emergency situations, however, it may also be used in any other reasonable locations where a seating apparatus attached to a wall is possible, including, but not limited to, parks, auditoriums, and public transportation vehicles, bus stops, train stations and the like. The seating apparatus is further meant to provide a safe place to sit in emergency situations. The seat may be constructed with one or more support members placed parallel to one another either vertically or horizontally, with respect to the ground. There are various means for attaching the one or more support members to the wall. For example, the one or more support members may be positioned within or behind the wall while the wall is being built. In another example, the one or more support members may be attached to the surface of an existing wall by various means.

In another embodiment, the seating apparatus comprises one or more component parts. One such component part may be a seating member. The seating member may include the surface on which a user of the seating apparatus may sit. The seating member may come in a variety of shapes as long as the user is able to sit on it. For example, the seating member may be in the shape of a square, rectangle, circle, or an oval. Another such component part may be one or more armrests. The armrests may serve as a location for a user to rest their arms while sitting in the apparatus. The armrests may also serve as a support means to help the user sit down into the apparatus or to get up out of the apparatus. Another such component part may be one or more strap systems. The strap systems may be used to help secure a user in place while sitting in the apparatus.

In another embodiment, each of said support members may comprise one or more attachment members where the component parts of the seating apparatus will attach to the support members. For example, each support member will have an attachment member for one or more armrests. Each support member will also have an attachment member for one or more seating members, said seating member having an attachment point on each support member. The attachment members can be rigid such that the seating apparatus is in a permanently fixed position or the attachment members can allow for rotation such that the seating apparatus may be rotated about said attachment members allowing it to rest against the wall.

The seating member may be attached to the plurality of support members at a plurality of attachment members. The seating member may attach to the support members in either a fixed state such that the seating member is not movable or in a state that allows for the seating member to rotate about the attachment member such that the seating member can come to rest in an up position that is parallel to the wall (e.g., in a vertical position) or in a down position that is perpendicular to the wall (e.g., orthogonal) allowing a user to sit on the seating member. The seating member can be constructed of a solid material (e.g., a single material) or a frame with suitable covering which may be constructed of a plurality of materials, including but not limited to, PVC or a PVC composite. The seating member may also contain a plurality of handles to be used when the seating member is in the down position. These handles are meant to provide physical and psychological comfort to the user of the seat. The seating member may also contain a portion designed to be grabbed (e.g., the grabbing portion). The grabbing portion may be located near the end of the seating member that is opposite of the side with attachment members. The purpose of the grabbing portion is to give a potential user a piece to assist with the application of force required to rotate the seating member from the up position to the down position. Another feature of the seating member is the addition of a shelf The shelf can be slidably disposed within the seating member, fixedly attached to and extend from the seating member, or hingedly attached to the seating member. The shelf may be used to support the user's personal items. The seating member may also range in length and width. For example, the seating member may range from 10-30 inches long and may range from 10-100 inches wide and range from 0.25-3.5 inches high. The large range in possible widths of the seating member allows the width to be extended such that multiple users may sit on the seating member at a time, such that the seating member becomes a bench member. The smallest embodiment of the seating member would be sized and/or contoured for a single occupant, but the length may be extended to accommodate multiple occupants. In the embodiment where the seating member may be extended to accommodate multiple occupants, additional support members may be used as necessary.

In yet another embodiment, the seating apparatus may comprise one or more armrests. Each armrest may attach to the support member at an attachment member. The first and second armrests will be placed at equal heights relative to the seating member (the heights above the seating member may be, for example, between 5 inches above the seating member up to 12 inches above the seating member). Each armrest may be fixed in a down position or rotate about the attachment member such that each armrest can rest in a down position for use as an armrest and in an off position where it rests against the wall. The off position may dispose the armrest above the attachment point so that the armrest is parallel with the support members, or to the left or right of the attachment point so that the armrest is perpendicular to the support members but in substantially the same plane, i.e., flush against the wall. The off position may alternatively or additionally dispose the armrest between the positions parallel and perpendicular to the support members, e.g., 45 degrees from the parallel position described above. In the embodiment where the armrests are allowed to rotate about the attachment member, the armrests can be set to rotate individually or a rod can be added connecting the two armrests such that when one armrest moves the other moves in concert.

The support members may also have a plurality of strap systems attached thereto. An embodiment may include an upper strap system and a lower strap system. The upper strap may be used for placement about the chest area of the occupant/user while the lower strap may be used for placement about the torso of the occupant/user. Each strap system can be designed in a plurality of fashions. For example, the strap system may include a section of strap material located on each of the support members allowing the left and right strap sections to meet and attach near the center of the occupant. In another embodiment, the entire strap section can be located on one support member allowing the strap section to extend across the entire occupant and attach to the nearest support member. The strap sections may also have a plurality of systems for storage while not in use. In one embodiment, each strap section may be physically inserted into a containing device by the user. In another embodiment, each strap section may be mechanically recoiled into a containing device by a recoil mechanism within the containing device.

BRIEF DESCRIPTION OF THE DRAWINGS

The above and other aspects, features, and advantages of certain embodiments will be more apparent from the following detailed description taken in conjunction with the accompanying drawings, in which.

DETAILED DESCRIPTION OF EMBODIMENTS OF THE PRESENT INVENTION

The following detailed description of certain embodiments will be made in reference to the accompanying drawings. In the detailed description, explanation about related functions or constructions known in the art are omitted for the sake of clearness in understanding the concept of the invention, to avoid obscuring the invention with unnecessary detail.

Figure 1:
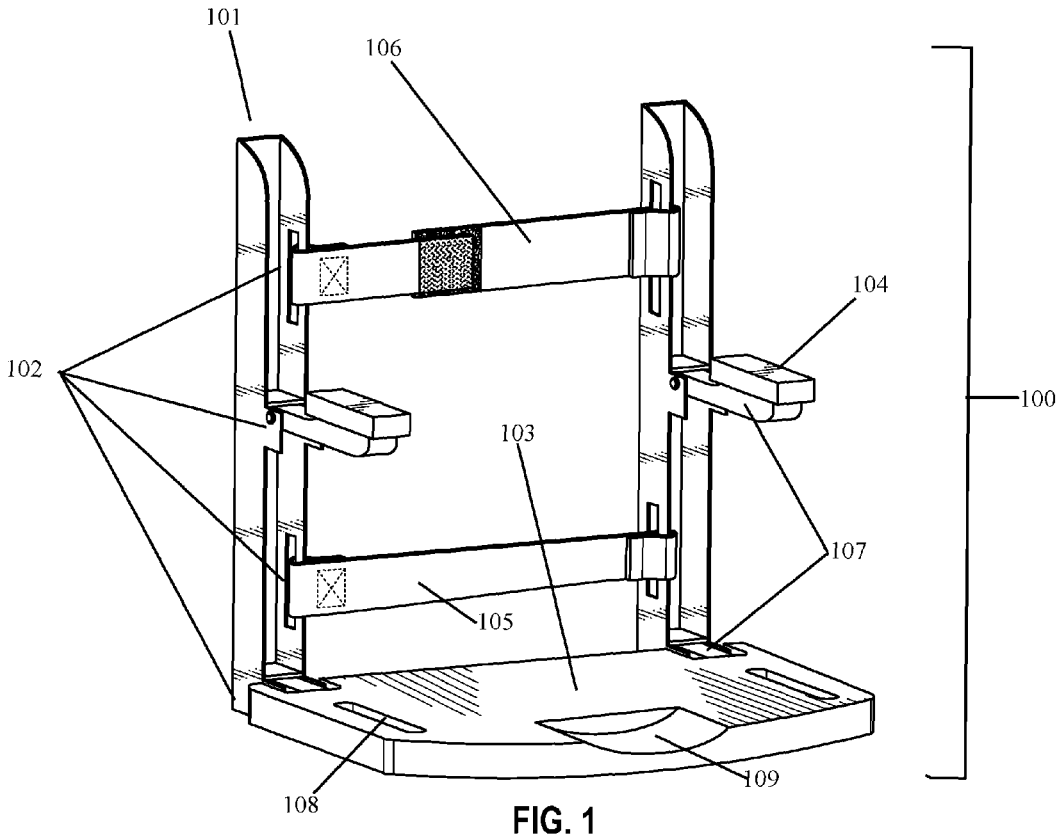
FIG. 1 illustrates a perspective view of a seating apparatus in the down position.

FIG. 1 illustrates a perspective view of a seating apparatus 100. The apparatus 100 includes a plurality of support members 101, each support member including a plurality of attachment members 102. The support members 101 attach to a plurality of component parts at the one or more attachment members 102. Component parts may include a seating member 103, armrest 104, a torso strap system 105, and a chest strap system 106. The component parts may attach to the support members by either attaching directly to the attachment members 102—shown, for example, in the figure for the torso strap system 105 and chest strap system 106—or by first attaching to a component arm 107, the component arm 107 then attaching to the attachment member 102—shown, for example, in the figure for the seating member 103 and armrest 104. Said component arm 107 including a proximal end and a distal end, the distal end attaching to the support member 101 and the proximal end attaching to the component part. FIG. 1 is an example of the seating member 103 and armrest 104 attaching to a component arm 107, said component arm 107 then attaching to the attachment member 102 of the support member 101. Further, the embodiment in FIG. 1 shows two possibilities for where the component arm 107 attaches to the component part. For example, in FIG. 1, the component arm 107 attaches to the bottom of the armrest 104 and a different component arm 107 is disposed within the seating member 103. Both component arm 107 attachment locations—underneath the component part and within the component part—are possible for each component part. That is, for example, the component arm 107 may be disposed within the armrest 104 and may also attach to the underside of the seating member 103. FIG. 1 is also an example of the torso strap system 105 and chest strap system 106 attaching directly to the attachment member 102 of the support member 101. FIG. 1 is also an example of the seating member 103 including two types of handles: side handles 108 of the seating member such that they are graspable by a user sitting in the apparatus if said user extends his hands straight down and a front indent 109 that would be located between the legs of a user sitting in the seating apparatus 100. The side handles 108 may consist of a rectangular opening with rounded edges in the seating member 103. The front indent 109 may include a groove in the seating member 103 such that it allows for gripping when moving the seating member 103 from up to down position and from down to up position. The front indent 109 may also include a knob placed on the front of the seating member 103. The front indent 109 may also be comprised of the same rectangular opening as seen for the side handles 108. FIG. 1 is further an example of the seating apparatus 100 in the down position.

The support members 101 may be constructed of a plurality of materials, including but not limited to, an aluminum channel or stainless steel. Stainless steel may be preferred to regular steel because it has higher corrosion resistance and can easily be formed into various shapes. Stainless steel's main non-iron constituents are chromium and nickel and may contain 17.5-20% chromium, 8-11% nickel, and less than 0.08% carbon, 2% manganese, 1% silicon, 0.045% (or 0-0.10%) phosphorus, and 0.03% (or 0-0.05%) sulfur. The seating member 103 and armrest 104 may also be constructed of a plurality of materials, including but not limited to, PVC or a PVC composite. The use of PVC is desirable because of its relatively low cost, resistance to biological and chemical degradation, and workability. PVC has a wide variety of composites created through additives that gives it many different uses. Additives can be added to make it harder and more rigid or more flexible. The PVC can also be layered, allowing for a middle vinyl foam layer that gives a more comfortable feel to the PVC. The materials used for the seating apparatus 100 may be structural in that materials used may be load bearing to the extent that an average user can safely rest his entire weight on the seating apparatus 100. The seating apparatus 100 may have a 3501*b* weight capacity to ensure the average user can rest his entire weight as well as personal belongings on the seating apparatus 100. Further, materials used for the seating apparatus 100 may be limited by any relevant construction codes based on the location of the seating apparatus 100. For example, if the seating apparatus 100 were to be located in an elevator, it would have to comply with all relevant elevator construction codes and any other applicable construction codes.

Figure 2:
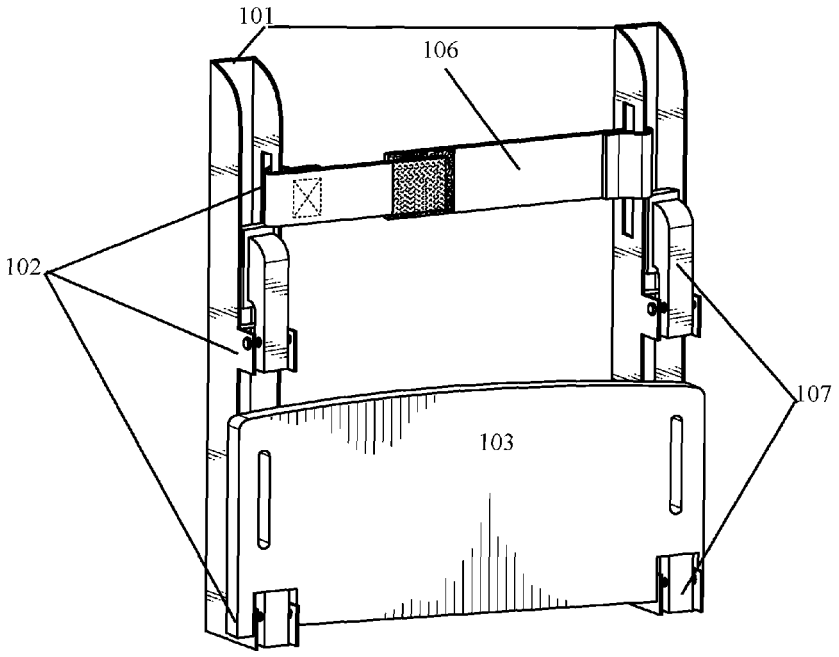
FIG. 2 illustrates a perspective view of a seating apparatus in the up position.

FIG. 2 illustrates a view of the seating apparatus 100 in the up position. Dimensions for the seating apparatus 100 may be as follows. The seating member 103 may be 20 inches long by 14 inches wide by 1.5 inches high. The armrests 104 may be 7 inches long by 3 inches wide by 1 inch high. Each support member 101 may be, at a minimum, long enough to extend from the seating member 103 at the bottom end up to the armrest 104 and, if a chest strap system 106 is included, sufficiently far above the armrest 104 to allow space for the attachment of the chest strap system 106. For example, a minimum length for a support member 101 may be 14 inches long, wherein this allows for 8 inches between the location of the seating member 103 and armrest 104 where a torso strap system 105 may be attached and 6 inches of extension above the armrest 104 where a chest strap system 106 may be attached.

The seating member 103 as shown in this figure may be extended upwardly, parallel to the support members 101, such that it covers more of the seating apparatus 100. That is, the seating member 103 will cover the armrest 104 and a larger amount of the support members 101. One reason this for this type of embodiment is to make the seating apparatus 100 as a whole more aesthetically pleasing. By extending the seating member 103 to cover more of the seating apparatus 100, when the seating apparatus 100 is in the up position the lower surface of the seating member 103 will cover most of the mechanisms that make up the seating apparatus 100.

Each support member 101 may have a plurality of attachment members 102. Said attachment members 102 allow for attachment of the component parts—seating member 103, armrests 104, torso strap system 105 and chest strap system 106—of the seating apparatus 100 to the support members 101. Attachment members may come in a variety of embodiments but will generally fall into two main sub-categories: fixed attachment members 110 (see, e.g., FIG. 3) and rotational attachment members 111 (see, e.g., FIG. 4A through FIG. 4C). A fixed attachment member 110 may be where the support member 101 and attached component—e.g. seating member 103—are fixed at an angle relative to one another, 90 degrees or at an angle that is best suited for use of the attached component part. Rotational attachment members 111 include where the support member 101 and attached component part—e.g. seating member 103—are attached in a manner that allows the angle made between the support member 101 and attached component part to change relative to one another. More detail on rotational attachment members 110 and fixed attachment members 110 is below.

Figure 3:
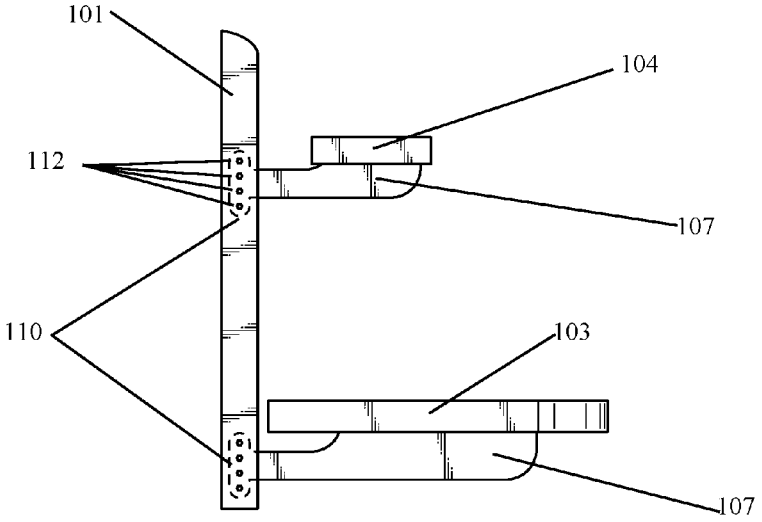
FIG. 3 illustrates a side view of a seating apparatus in the down position with fixed attachment members.

FIG. 3 illustrates a side view of the apparatus 100 with fixed attachment members 110 for the seating member 103 and armrest 104. The fixed attachment members 110 may include the attachment of the proximal end of a component arm 107 to the support member 101. The component part (e.g., seating member 103, armrest 104, torso strap system 105, or chest strap system 106) would then attach towards the distal end of the component arm 107. For example, the component part—e.g. seating member 103, armrest 104, torso strap system 105, or chest strap system 106—may attach to the distal end of the component arm 107 and the proximal end of the same component arm 107 would attach to the support member 101. The component arm 107 may be attached to the support member 101 either permanently, where the component arm 107 cannot be detached from the support member 101, or removably, where the component arm 107 can be detached from the support member 101. Some examples of permanent attachment members include welding the component arm 107 to the support member 101, riveting the component arm 107 to the support member 101, or constructing the component arm 107 and support member 101 as one continuous/integral piece/member. The embodiment of FIG. 3 is an example of a removably attached component arm 107, which uses a plurality of nuts and bolts 112 to attach the component arm 107 to the support member 101.

Figure 4A:
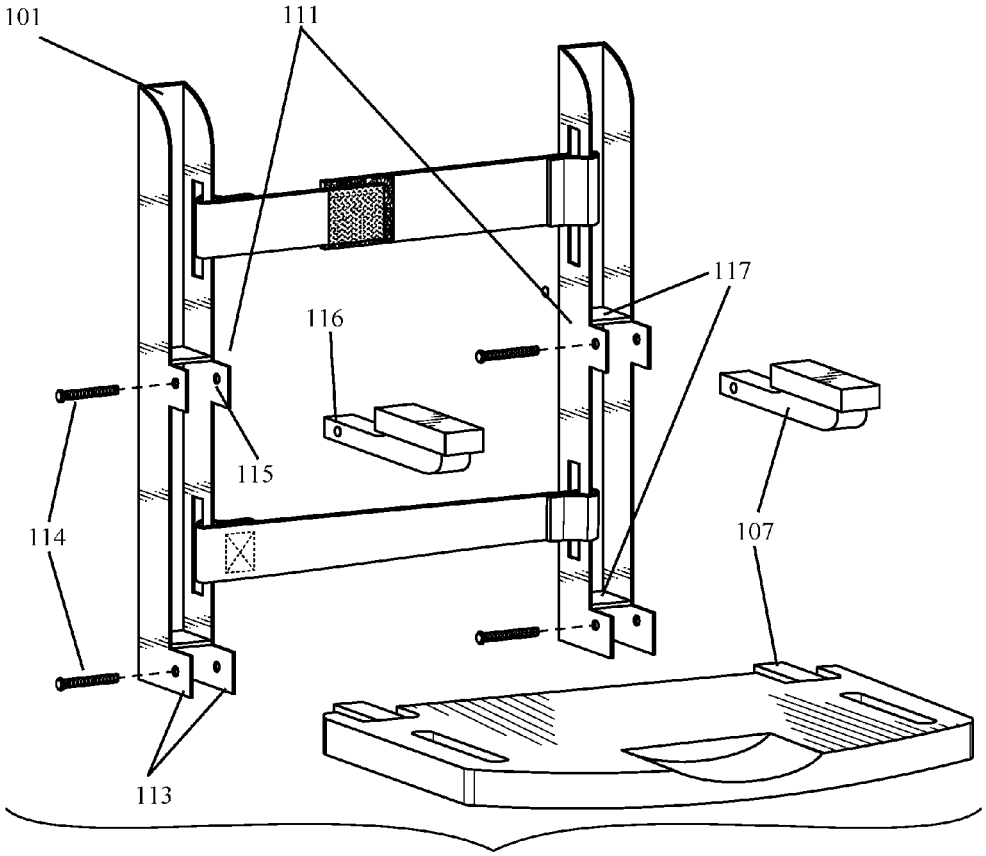
FIG. 4A illustrates a seating apparatus with hinged attachment members.

FIG. 4A illustrates a view of the apparatus 100 with rotational attachment members 111. The rotational attachment member 111 may include a hinge member that rotatably connects the proximal end of the component arm 107 to the support member 101. A description of the hinge member that makes up the rotational attachment member 111 embodied in this figure follows. At the location of the rotational attachment member 111 on the support member 101, the support member 101 may have a plurality of flanges 113 extending from the support member 101 perpendicularly from the wall it is attached to. Each flange 113 may be shaped in a plurality of ways, for example, in the embodiment shown, each flange 113 is shaped rectangularly. Another possible shape for the flange 113 is to shape it in a half-parabola fashion wherein the apex of the half "U" shaped parabola is where the flange 113 and support member 101 meet. Another possible shape for the flange 113 would be to make them triangular where the base is attached to the support member 101 and the peak of the triangle extends outward from the support member 101. The plurality of flanges 113 may be separated by a distance sufficient that the component arm 107 may fit between the flanges 113, for example, the flanges 113 may be separated by 0.25 inches to 2.00 inches, depending on the width of the component arm 107. The component arm 107 may then attach to the flanges 113 in a fashion that allows for rotation of the component arm 107 with respect to the stationary flanges 113. One possible embodiment of connection between the component arm 107 and flange 113 is by use of a pin hinge 114. The pin hinge 114 may be made of stainless steel or any other material sufficient to be load bearing. The pin hinge 114 may pass through flange apertures 115 and component arm apertures 116 allowing for free rotational movement of the component arm 107 with respect to the flange 113 while still keeping them connected. Flange apertures 115 and component arm apertures 116 may be circular or oval. A protrusion block 117 may be affixed to the support member 101 in a location that may stop the component arm 107 from rotating past a predetermined angle, for example, 90 degrees relative to the wall the support member 101 is attached to. The protrusion block 117 stops the component arm 107 from rotating by acting as a resting place for the portion of the component arm 107 closest to the wall. That is, the portion of the component arm 107 between the component arm aperture 116 and the proximal end of the component arm 107 will rest on the bottom surface of the protrusion block 117 when the component arm 107 is in the desired down location. As the component arm 107 rotates from the up position to the down position the component arm 107 will rotate clockwise about the hinge member. This causes the portion of the component arm 107 extending from the component arm aperture 116 towards the wall to rotate towards the protrusion block 117. When the component arm 117 reaches the down position the top side of the component arm 117 end closest to the wall will come in contact with the protrusion block 117, the protrusion block 117 preventing any further rotation. The protrusion block 117 may be welded to the support member 101, manufactured as part of the support member 101 (e.g., integral), or attached to the support member 101 using nuts and bolts 112. The embodiment shown in FIG. 4A shows the protrusion block 117 as being manufactured as part of the support member 101.

Figure 4B:
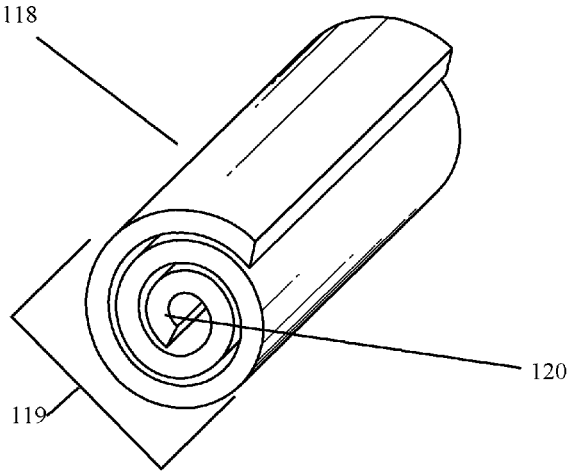
FIG. 4B illustrates a spring pin biasing device.

The rotational attachment member 111 may contain a biasing device that biases the support member 101 and the component arm 107 to rotate away from each other, causing the apparatus 100 to rotate to the down position. One example of a biasing device may be to replace the pin hinge 114 with a spring pin 118. FIG. 4B illustrates an embodiment for the spring pin 118. The spring pin 118 is a strip of material rolled into a coil. The material of the spring pin 118 may be metal, such as steel or carbon steel. The spring pin diameter 119 may be slightly (e.g., 0-10% or 5%) larger than each of the flange aperture 115 and component arm aperture 116 such that once inserted into the aperture the spring pin 118 creates friction between the interior wall of the flange aperture 115 and the spring pin 118, causing the flange aperture 115 and the spring pin 118 not to move relative to one another. The friction is created because the spring pin 118 material retains elastic properties after installation into the flange aperture 115 and component arm aperture 116 and exerts a force on the walls of the apertures. As the component arm 107 rotates, the innermost coil 120 of the spring pin 118 coils inward and the elastic properties of the spring pin 117 material bias the component arm 107 back to the original position prior to rotation. The bias may be increased, thus requiring more force to cause the spring pin 118 to coil inward, by using a thicker material for the spring pin 118. Similarly, the bias may be decreased by using a thinner material for the spring pin 118. By inserting the spring pin 118 when the component arm 107 is in the down position, the component arm 106 will be biased towards the down position whenever rotated away from the down position.

Figure 4C:
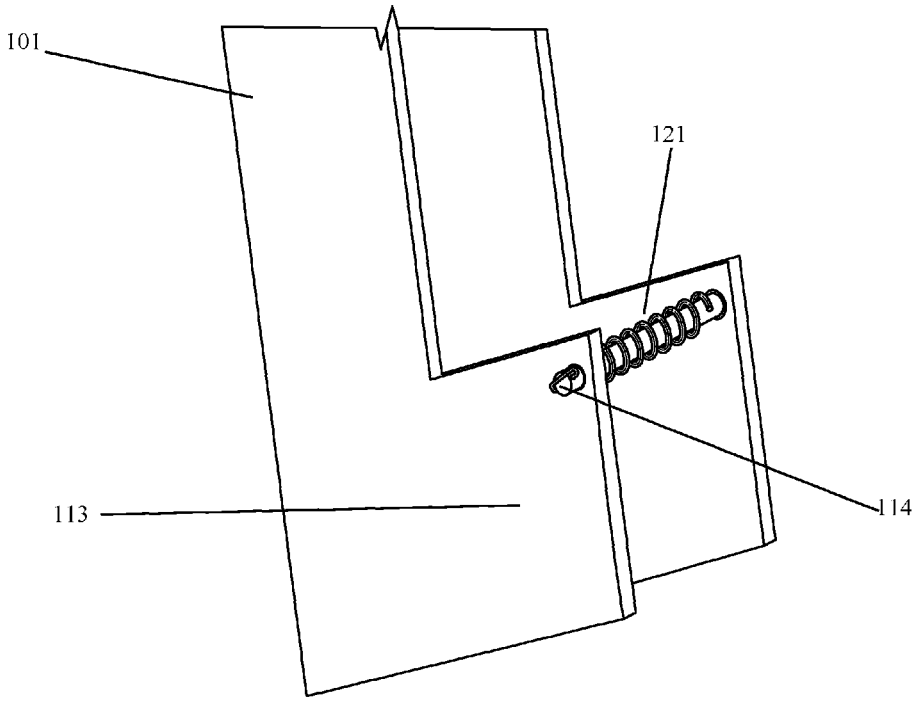
FIG. 4C illustrates a biasing spring biasing device.

Another example of a biasing device may be to add a biasing spring 121 to the pin hinge 114, as shown in FIG. 4C. FIG. 4C illustrates one embodiment for the biasing spring 121. In this embodiment, the pin hinge 114 may be attached to the flange 113 such that it is not free to rotate. One end of the biasing spring 121 may then be held in place by fitting it through an aperture in the spring pin 114 (not shown). The biasing spring 121 may then wrap around the pin hinge 114. The end of the biasing spring 121 not attached to the pin hinge 114 then would terminate on the component arm 107 (not shown) in such a way that the component arm 107 holds that end of the biasing spring 121 in place. That is, one end of the biasing spring 121 terminates on the stationary spring pin 114 and the other end of the biasing spring 121 terminates on the rotatably connected component arm 107. Therefore, when the component arm 107 rotates, the biasing spring 121 winds, creating tension that biases the component arm 107 back to its original set location. Another possible embodiment for the biasing spring 121 would include allowing the pin hinge 114 to rotate with respect to the flange aperture 116, but not with respect to the component arm 107. That is, the pin hinge 114 would be attached to the component arm 107 such that it rotates with the component arm 107. The biasing spring 121 would still wrap around the pin hinge 114 but now the biasing spring 121 would have one end terminating on the flange 113 and the other end terminating on either the pin hinge 114 or component arm 107. Thus, again, when the component arm 107 rotates, the pin hinge 114 rotates with it, and the biasing spring 118 end terminated on the flange 113 would remain stationary while the end terminated on the pin hinge 114 or component arm 107 would rotate, causing the biasing spring 121 to wind, creating a force pushing the component arm 107 back to its original position.

The biasing device, whether the embodiment uses a spring pin 118 or biasing spring 121 (or another embodiment), may be installed such that the component arm 107 is either biased or reverse biased. That is, if used to bias the component arm 107, the component arm 107 will have a force exerted on it by the biasing device pushing the component arm 107 towards the support member 101 such that the apparatus 100 comes to rest in the up position. For a reverse bias, the component arm 107 will be forced away from the support member 101 such that it comes to rest in the down position.

In one embodiment wherein only the biasing device is used, the apparatus remains in the down position allowing a user to sit on the apparatus. The component parts may then be forcibly rotated against the bias to the up position; at which point a locking mechanism (not shown), such as a latch, magnets, strap, or hook, may lock the component parts in the up position. The locking mechanism may be automatic, and lock when the angle between the support member 101 and component arm 107 becomes sufficiently small. The locking mechanism may also be manual wherein the user must lock the component arm 107 in the up position.

In another embodiment wherein only the reverse biasing device is used, the apparatus remains in the up position. The apparatus would then need to be forcibly rotated by a user to the down position to allow a user to sit. Once in the down position, a locking mechanism may lock the component arm 107 at an angle suitable for use of the component part, for example 90 degrees with respect to the wall the support member 101 is attached to because this angle will allow the user to sit on the apparatus 100. In another embodiment, the user's weight would keep the seating apparatus 100 in the down position while in use and when not in use the reverse biasing device would rotate the component arm 107 towards the support member 101 until the apparatus is in the up position.

Figure 5A:
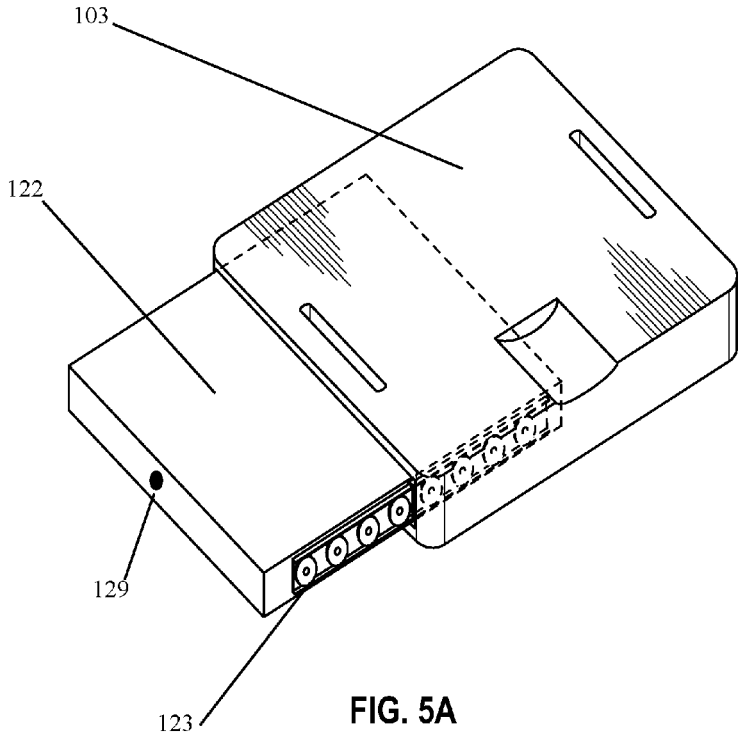
FIG. 5A illustrates a shelf that may be part of the seating member of the seating apparatus.
Figure 5B:
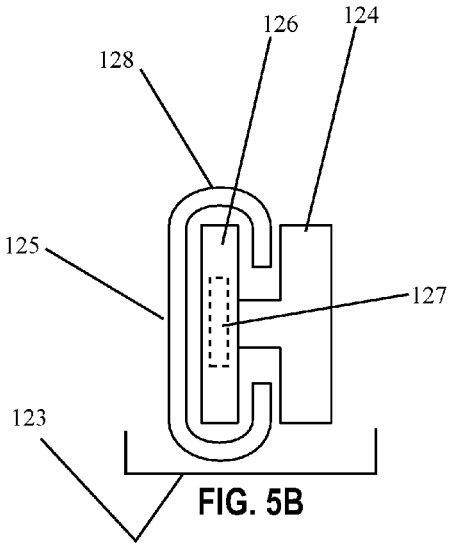
FIG. 5B illustrates the sliding members for the shelf of the seating member.

FIG. 5A illustrates an embodiment of the seating member 103 that includes a shelf 122. The shelf 122 may be, for example, 3 inches to 8 inches wide by 4 inches to 10 inches long by 0.25 inches to 2 inches thick. These dimensions allow the shelf to fit within the seating member 103 such that the shelf 122 is not visible unless it is extended from its resting position within the seating member 103. Other possible dimensions may be possible as well, provided the dimensions allow the shelf 122 to be disposed within the seating member 103. In one embodiment the shelf 122 may be slideable such that it can be stored within the seating member 103 while not in use. In one embodiment in which the shelf 122 is able to slide, there may be a plurality of sliding members 123 that attach to opposite sides of the shelf 122 and run parallel to the intended sliding direction of the shelf 122. FIG. 5B illustrates a cutout view of the sliding members 123 looking down the length of the sliding members 123. FIG. 5B further illustrates one feature of the sliding members 123. In this feature, the sliding members 123 include two separate rails: a shelf rail 124 and a housing rail 125. The shelf rail 124 attaches directly to a side of the shelf 122. The shelf rail 124 has a plurality of wheels 126 and bearings 127 that extend outward from the shelf rail 124. The housing rail 125 attaches to an inside wall of the seating member 103 opposite the location of the shelf rail 124. The housing rail 125 includes a curved piece 128, which is slightly larger than the wheel 126 of the shelf rail 124. The housing rail 125 allows the wheel 126 of the shelf rail 124 to turn within the housing rail 125 allowing the shelf 122 to slide in and out of the seating member 103. In another embodiment, the shelf rail 124, including wheels 126 and bearings 127, may be attached to the inside of the seating member 103 and the housing rail 125 may be attached to the shelf 122. That is, the shelf rail 124 and housing rail 125 may switch locations. Another feature of this sliding member 123 includes a cut out (not shown) at each end of the housing rail 125 large enough for a wheel 126 of the shelf rail 124 to rest in such that the wheel 126 will not move unless lifted from the cutout. This allows the shelf 122 to come to a resting position while either entirely within the seating member 103 or when pulled out of the seating member 103 to a sufficient length. Another feature of the shelf 122 is a gripping device 129 (as shown on FIG. 5A). The gripping device 129 may be attached to the end of the shelf 122 allowing a user to more easily grasp the shelf 122 when sliding the shelf 122 into or out of the seating member 103. The gripping device 129 may include a knob, a handle, or grooves machined into the shelf 122.

Figure 6:
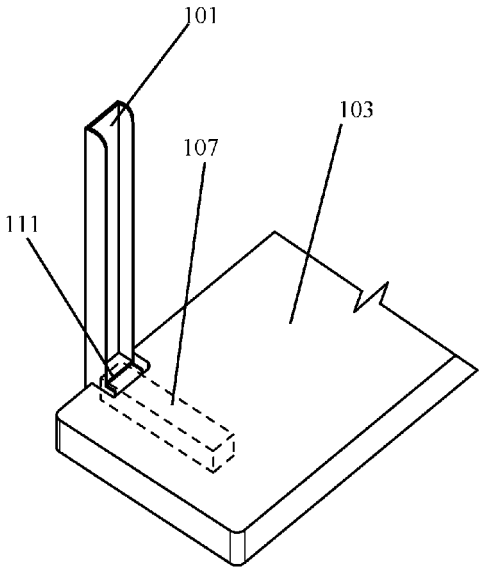
FIG. 6 illustrates one way the component arm may be disposed of within the component parts, as shown in this figure using the seating member.

FIG. 6 illustrates an embodiment of the component part construction wherein the component arm 107 is disposed within the component part. In this embodiment, the majority of the component arm 107 is not visible when the seating apparatus 100 is in the up or down position. FIG. 6 shows an example of an embodiment for one component arm 107 for the seating member 103. In this embodiment, the seating member 103 wraps around the rotational attachment member 111, thus keeping the rotational attachment member more out of eyesight. The portion of the component arm 107 disposed within the component part, in this embodiment the seating member 103, may be attached to the component part. Any means of attachment may be suitable, such as an adhesive, rivets, nuts and bolts, or any other means.

Figure 7A:
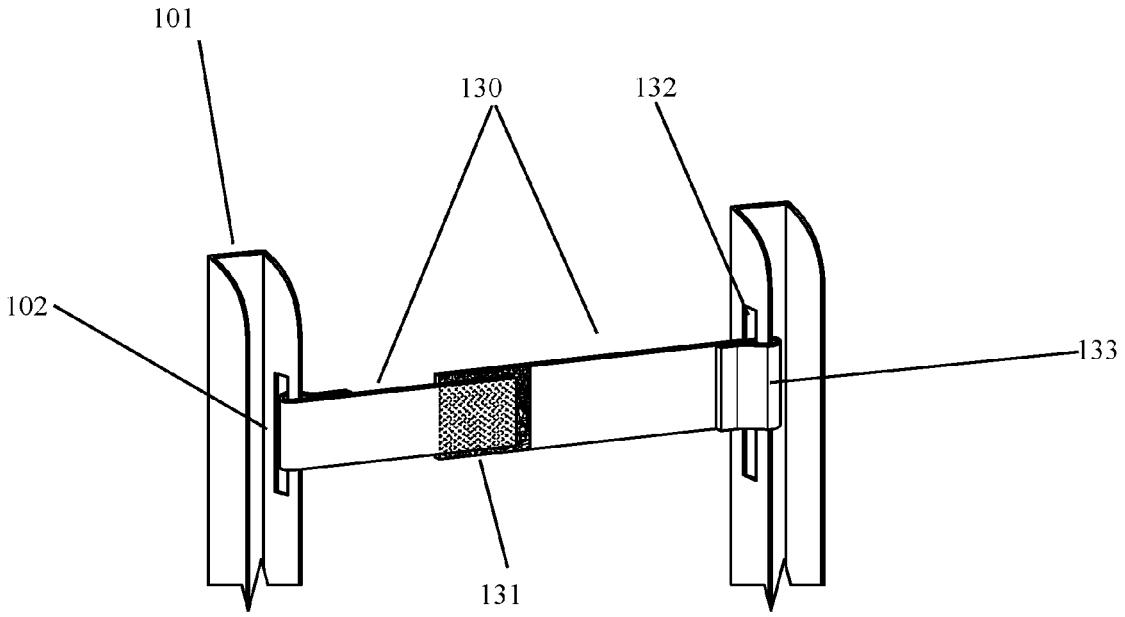
FIG. 7A illustrates the chest strap system that may be used with the seating apparatus to secure a user while using the seating apparatus.

FIG. 7A illustrates an embodiment of the chest strap system 106. In one embodiment, the chest strap system 106 may include an attachment member 102 on one or more support members 101, one or more chest straps 130, and one or more fastening members 131. The width of the chest strap 130 may be anywhere, for example, from 2 inches to 8 inches wide with 5 inches wide being an embodiment since 5 inches is sufficiently wide so as not to bruise the user in case of an abrupt movement, and the chest strap 130 may be constructed of, including but not limited to, a canvas or nylon type material and may include a padded element for further comfort. In one embodiment there are two chest straps 130, each attached to an adjacent support member 101 at an attachment member 102. Said attachment members 102 may include a rectangular aperture 132. The one or more chest straps 130 each include a wrapper member 133 that attaches around a rectangular aperture 132 on a support member 101. The one or more adjacent chest straps 130 may attach to each other in between adjacent support members 101 using a fastening member 131. One possible fastening member 131 may be hook-and-loop fasteners. The torso strap system 105 may also be embodied in the fashion shown in FIG. 7A and described above e.g. the two strap system with adjacent straps meeting in the middle of the user.

Figure 7B:
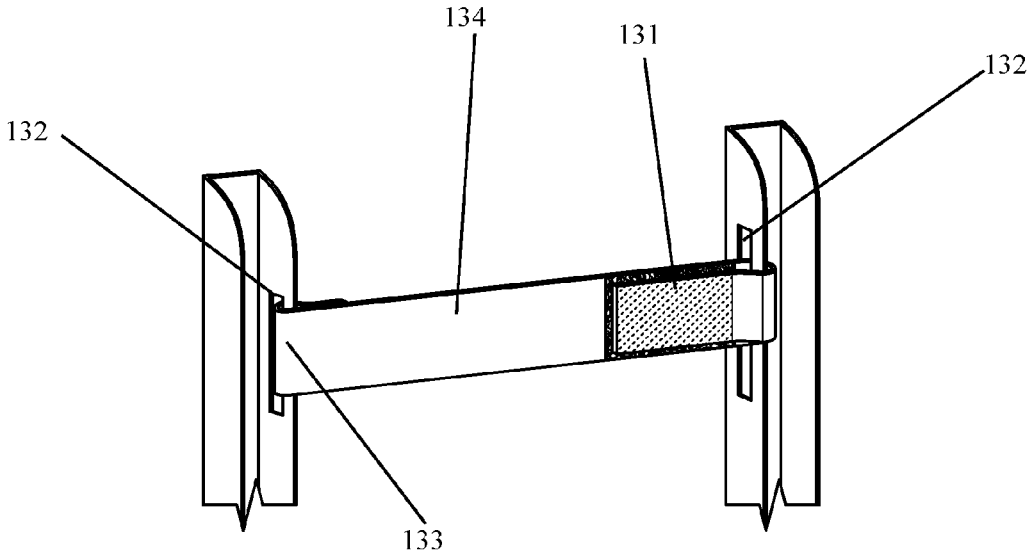
FIG. 7B illustrates the torso strap system that may be used with the seating apparatus to secure a user while using the seating apparatus.

FIG. 7B illustrates an embodiment of the torso strap system 105. In one embodiment the torso strap system 105 may include one or more attachment members 102, a torso strap 134, and a fastening member 131. The torso strap 134 may be long enough to extend across the user from one support member 101 and attach to an adjacent support member 101 on the opposite side of the user. The torso strap 134 may also be anywhere from 1 inch to 5 inches wide with 2 inches wide being one embodiment because a 2 inch wide torso strap 134 would sit comfortably across a user's waist while still keeping the user secure. The torso strap 134 may be constructed of, including but not limited to, a canvas or nylon type material and may include a padded element for further comfort. In one embodiment, the attachment member may include a rectangular aperture 132, said rectangular aperture 132 being long enough to allow the torso strap 134 to fit flatly therein. In another embodiment, the torso strap 134 may include two ends: one end including a wrapper member 133 and the other including a fastening member 131, such as hook-and-loop fasteners. The torso strap 134 end includes wrapper member 133 attached around one rectangular aperture 132. The torso strap 134 end includes a fastening member 131 extends to an adjacent support 101 member with a rectangular aperture 132, the torso strap 134 extendable through the rectangular aperture 132 and able to wrap back upon itself and attach to at an attachment location to said same torso strap 134 using the fastening member 131. The chest strap system 106 may also be embodied in the fashion shown in FIG. 7B and described above e.g. the single strap system that extends across the user and passes through an adjacent support member 101 to wrap back upon itself.

In yet another, not pictured embodiment, the chest strap system 106 or torso strap system 105 may include a retractor mechanism. The retractor mechanism will be described in terms of the torso strap system 105 in this paragraph but it may also be applied to the chest strap system. In one feature, the retractor mechanism may include a spring assembly wherein extension of the torso strap 134 causes the spring assembly to wind, increasing its stress. When the torso strap 134 is released, the spring assembly unwinds, causing the torso strap 134 to retract into the retractor mechanism. Therefore, the retractor mechanism doubles as a storage space for the torso strap 134. In another feature, the retractor mechanism may include a locking mechanism. The locking mechanism may be engageable by a user when the torso strap 105 has been extended to a desired length. The locking mechanism may also be engageable automatically when the torso strap 134 is extended past a threshold velocity (for example, that of a sudden rapid pull of the torso strap 134). In another feature, the retractor mechanism may include a compartment for storing the torso strap 134. The fastening member 131 may then attach to an adjacent support member 101 and allow for tightening or loosening of the torso strap 134 to achieve the desired length.

Figure 8:
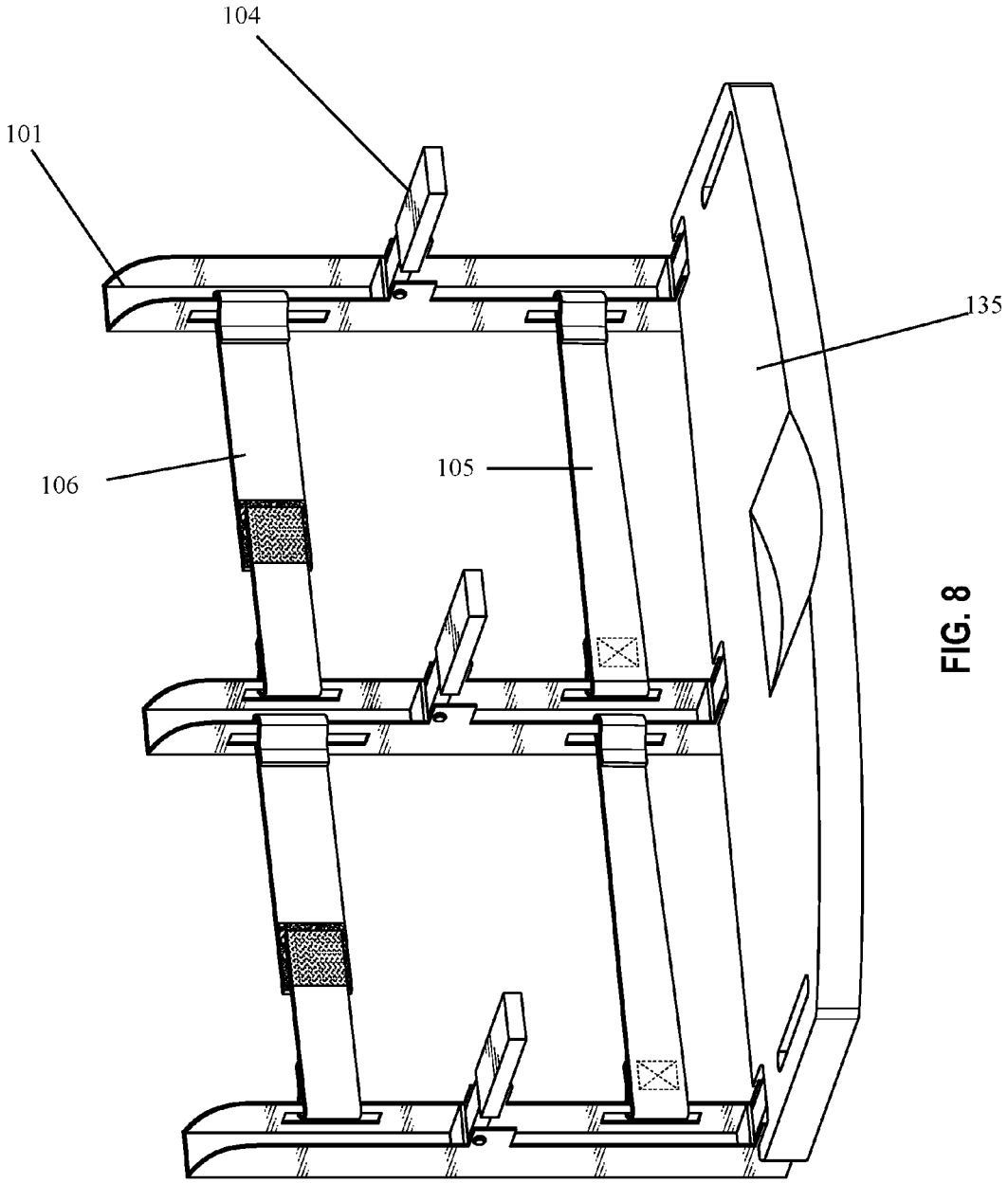
FIG. 8 illustrates the seating apparatus with an extended seating member such that multiple users may use the seating apparatus at a time, thus creating a bench member.

FIG. 8 illustrates an embodiment of the seating apparatus 100 wherein the length of the seating member 103 has been elongated such that multiple users can sit, at the same time, creating a bench member 135. The elongated seating member 103 may be at least 40 inches long or at least as long as necessary to fit two users on the seating apparatus. In one feature of this embodiment, additional support members 101 may be added to accommodate the extra weight of multiple users. A benefit of additional support members 101 may allow for additional armrests 104 such that each user may have an armrest 104 accessible to them. Similarly, additional support members 101 may allow for additional torso strap systems 105 and chest strap systems 106 such that each user may have access to them.

Figure 9:
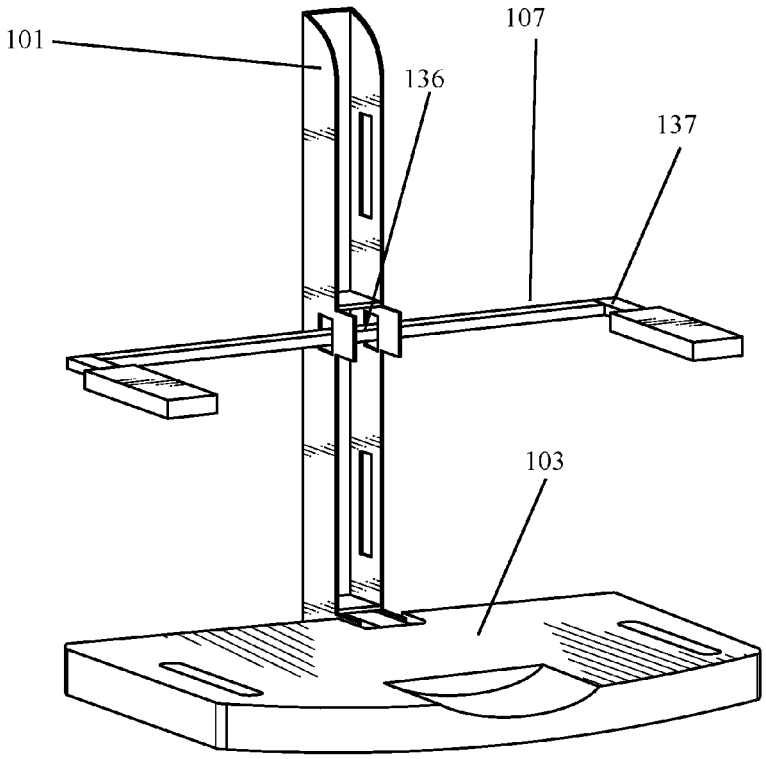
FIG. 9 illustrates an embodiment of the seating apparatus with a single support member.

FIG. 9 illustrates an embodiment of a single user seating apparatus 100 with a single support member 101. The support member 101 bisects seating member 103. Another feature of this embodiment is that the component arm 107 retains a generalized "U" shape wherein the bottom of the "U" 136 attaches to the support member 101 and each tip of the "U" 137 attaches to the given component part, for example the seating member 103 or armrest 104.

Figure 10:
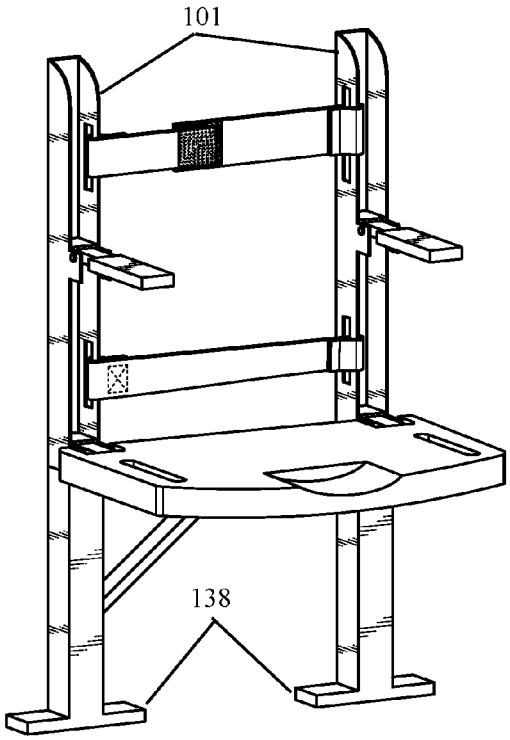
FIG. 10 illustrates an embodiment of the seating apparatus with support members that extend to the floor.

FIG. 10 illustrates an embodiment wherein the support members 101 may be extended down to the floor. One feature of this embodiment allows the bottom end of the support members 101 to have a floor flange 138 that may rest against the floor. The floor flange 138 may be any shape that increases surface area contact with the floor, for example, the floor flange 138 may be square, rectangular, circular, triangular or any other beneficial shape. The floor flange 138 creates extra surface area wherein the support member 101 comes in contact with the floor. This embodiment may be beneficial to use when attaching the seating apparatus 100 to a glass wall. Allowing the support member 101 to partially rest on the floor by way of the floor flange 138 may alleviate some of the force exerted on where the support members 101 are attached to the wall.

What is claimed is:

1. A seating apparatus, comprising:

one or more support members comprising one or more attachment members including one or more strap systems, said attachment members including a rectangular aperture, said rectangular aperture adapted to fit a strap flatly in said rectangular aperture, wherein the one or more strap systems includes a torso strap system comprising a torso strap including a wrapper member at one end and hook and loop fasteners at another end, said wrapper member attached around one rectangular aperture attachment member, said rectangular aperture attachment member located on a support member between a seating member and armrest member, said torso strap extendable through a rectangular aperture attachment member on an adjacent support member and wrapping back upon itself, said torso strap affixing at an attachment point on said same torso strap with hook and loop fasteners;

the seating member including a component arm for attachment to an attachment member of the one or more support members; and the armrest member including one or more armrest members, each including a component arm for attachment to an attachment member of the one or more support members.

2. The apparatus of claim 1, further comprising a securing member configured to secure said one or more support members to a wall.

3. The apparatus of claim 1, wherein a length of the seating member is elongated to be at least 40 inches long.

4. The apparatus of claim 1, wherein the one or more support members are extended downward with the bottom end of the support members comprising a floor flange, wherein said floor flange allows an increased surface area of the support member to rest on the floor.

5. The apparatus of claim 1, wherein the component arm is comprised within the seating member or one or more armrest members.

6. The apparatus of claim 1, wherein the seating member further comprises a shelf, said shelf located within a seating member cavity, said shelf comprising:

one or more sliding members including a one or more shelf rails and one or more housing rails, said shelf rail fastened to the edge of the shelf and including wheels and bearings, said housing rail fastened to the wall of the seating member cavity and enclosing the wheels of the shelf rail.

7. The apparatus of claim 6, wherein the shelf is attached to the bottom surface of the seating member.

8. The apparatus of claim 1, wherein the component arm of the seating member capable of attachment to an attachment member of the one or more support members comprises a proximal end and distal end, wherein said proximal end attaches to the one or more support members and said distal end attaches to the seating member or one or more armrest members.

9. The apparatus of claim 8, wherein the component arm comprises a fixed attachment to the attachment member of the support member.

10. The apparatus of claim 8, wherein the component arm comprises a rotatable attachment to the attachment member of the support member.

11. The apparatus of claim 10, wherein the rotatable attachment comprises a hinge member, wherein said hinge member comprises a biasing device.

12. A seating apparatus, comprising:

one or more support members comprising one or more attachment members;

a seating member including a component arm for attachment to an attachment member of the one or more support members; and one or more armrest members, each including a component arm for attachment to an attachment member of the one or more support members, wherein the one or more support members further includes a one or more attachment members including a one or more strap systems, said attachment members include a rectangular aperture, said rectangular aperture adapted to fit a strap flatly in said rectangular aperture, wherein the strap system includes a chest strap system comprising a one or more chest straps, said chest straps each including a wrapper member around one or more rectangular aperture attachment members, said rectangular aperture attachment members located on adjacent support members above the armrest members;

said one or more chest straps affixing to an adjacent chest strap with hook and loop fasteners.

13. The apparatus of claim 12, wherein the seating member further comprises a shelf, said shelf located within a seating member cavity, said shelf comprising:

one or more sliding members including a one or more shelf rails and one or more housing rails, said shelf rail fastened to the edge of the shelf and including wheels and bearings, said housing rail fastened to a wall of the seating member cavity and enclosing the wheels of the shelf rail.

14. The apparatus of claim 12, wherein the component arm is comprised within the seating member or one or more armrest members.

15. The apparatus of claim 12, wherein the one or more support members are extended downward with the bottom end of the support members comprising a floor flange, wherein said floor flange allows an increased surface area of the support member to rest on the floor.

16. The apparatus of claim 12, further comprising a securing member configured to secure said one or more support members to a wall.

17. The apparatus of claim 12, wherein the component arm of the seating member capable of attachment to an attachment member of the one or more support members comprises a proximal end and distal end, wherein said proximal end attaches to the one or more support members and said distal end attaches to the seating member or one or more armrest members.

18. The apparatus of claim 17, wherein the component arm comprises a fixed attachment to the attachment member of the support member.

19. The apparatus of claim 17, wherein the component arm comprises a rotatable attachment to the attachment member of the support member.

20. The apparatus of claim 19, wherein the rotatable attachment comprises a hinge, wherein said hinge member comprises a biasing device.

* * * * *